United States Patent [19]

Anton

[11] 3,941,490

[45] Mar. 2, 1976

[54] BALL POINT PEN

[76] Inventor: Steve M. Anton, 11314 Avenue O, Chicago, Ill. 60617

[22] Filed: Apr. 1, 1974

[21] Appl. No.: 456,832

[52] U.S. Cl. ..... 401/110
[51] Int. Cl. ..... B43k 24/08
[58] Field of Search ..... 401/109–113, 401/116, 209

[56] References Cited

UNITED STATES PATENTS

| | | | |
|---|---|---|---|
| 3,095,859 | 7/1963 | Levy | 401/110 X |
| 3,137,276 | 6/1964 | Weisser | 401/111 |
| 3,419,336 | 12/1968 | Kirk | 401/111 |
| 3,544,227 | 12/1970 | Green | 401/110 X |
| 3,652,173 | 3/1972 | Miller et al. | 401/110 |

*Primary Examiner*—Lawrence Charles
*Attorney, Agent, or Firm*—Ralph H. Dougherty

[57] ABSTRACT

This application relates to a ball point pen and more particularly to a mechanism for turning or rotating the ink cartridge each time the plunger is depressed to project the ball point from the pen into the writing position.

4 Claims, 1 Drawing Figure

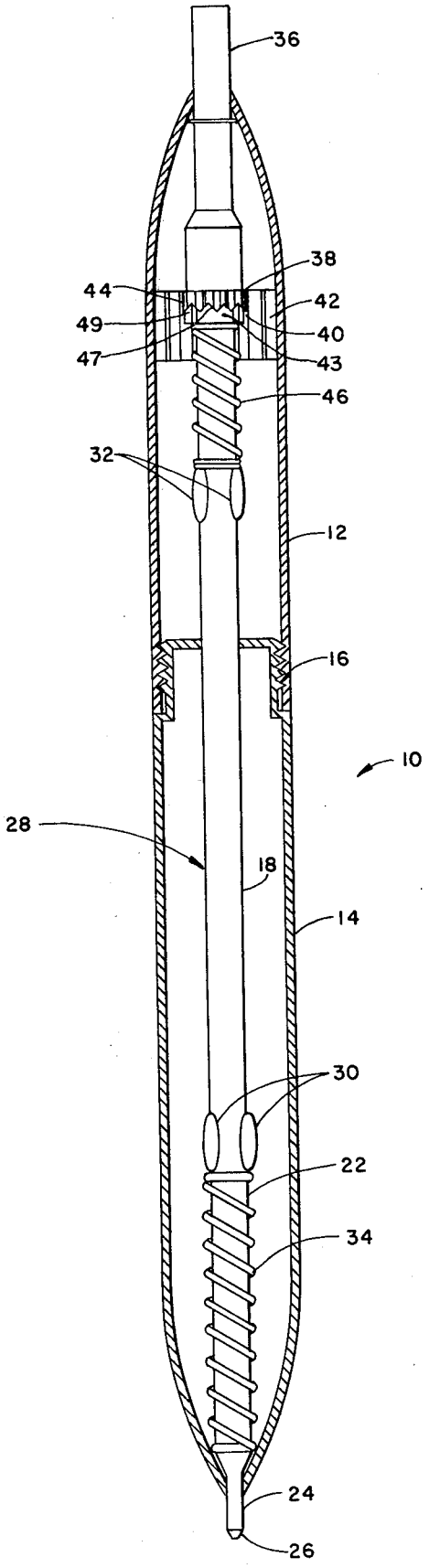
36
38
44
42
49
40
47
43
46
32
12
16
10
28
18
14
30
22
34
24
26

BALL POINT PEN

BACKGROUND OF THE INVENTION

Ball point pens are normally held in the same relationship to the writer's hand at each time they are used. The pressure of the writer's hand causes the ball to wear the top of the nib until a gap is formed between the ball and the side of the ball holder. Ink will leak through the gap into the pocket of the wearer. Further, the ball can get hung up on a corner when the wear of the nib is excessive. This freezes the ball, keeping it from rotating and picking up ink, thus rendering the pen useless.

I have invented a mechanism for use on any ordinary plunger type ball point pen which rotates the cartridge and ball holder each time the point is projected into the writing position. This mechanism has the further advantage of increasing the useful life of each refill by a factor of three. Project-retract mechanisms for ball-point pens to which this invention is applicable are well known in the art as exemplified by U.S. Pat. Nos. 3,137,276 and 3,652,173.

OBJECT OF THE INVENTION

It is the primary object of this invention to provide an apparatus for reducing the wear on the ball holder by rotating the ball cylinder into a different orientation at each time the pen is used.

BRIEF DESCRIPTION OF THE DRAWING

This and other objects will become more readily apparent by reference to the following detailed specification and the appended drawing in which:

The single FIGURE is an elevational cross-section of a ball point pen in accordance with my invention.

DETAILED DESCRIPTION

Referring now to the FIGURE, the pen 10 includes a case or housing comprising an upper housing section 12 and a lower housing section 14 which are threadedly engaged at 16. A generally tubular ink reservoir 18 is centrally situated within the case. From the lower end of the reservoir protrudes a feed tube 22, which in turn carries a nib 24 which holds a writing ball 26 at its lower end. These parts constitute replaceable cartridge unit 28. A pair of flattened shoulders 30 are provided near the lower end of the tubular reservoir, and a second pair of shoulders 32 are provided near the upper end of the reservoir. A coil compression spring 34 disposed around reservoir 18 bears against the bottom of lower section 14 of the case and against the lower shoulders 30 normally urging the point and the cartridge unit 28 upwardly to a retracted position within the case. The upper section 12 of the housing carries a stem or plunger 36 which protrudes therethrough, and has a series of annular grooves 40 and 44 alterating between a deep retracted position groove 40 and a shallow writing position groove 44. The plunger 36 carries a series of bosses 38 at its lower end which engage deep grooves 40 on the inside of case insert 42 and prevent it from rotating. The plunger is engaged, on its underside, by a gear 42 which is adapted for alignment with the longitudinal axis of plunger 36 as well as for mating engagement by teeth 47 on the underside of the plunger. Gear 43 carries on its circumference a number of bosses 49, each having a beveled upper edge. The bosses 49 engage either slots 40 or 44 within insert 42. When the plunger is released, the pressure of compression spring 34 causes gear 43 to remain in shallow grooves 44, thus the cartridge remains in the writing position. When the plunger is depressed a second time, a beveled edge on the boss 38 causes the gear to rotate through a very small angle to allow boss 49 to be aligned with grooves 44, and the plunger 36, the intermediate member 43 and the cartridge 28 retract.

An upper compression spring 46 is disposed about the reservoir 18 between the upper flanges or shoulders 32 and the bottom or bearing surface of the gear 43. The spring 46 may be in contact with any enlargement of the cartridge in place of flanges 32. In operation, when the plunger is depressed, it compresses both the upper and the lower springs. The upper spring, bearing against flanges 32 and the bottom of rotatable gear 43, twists the cartridge in the case according to the amount of rotation of gear 43, depending on the amount of compression that has been preintroduced to the spring.

By providing all cartridges with these upper shoulders or some form of enlargement, and an upper compression spring, any plunger-type pen can be made to twist upon releasing of the plunger. This results in more even wear of the ball.

ALTERNATIVE EMBODIMENTS

It will be understood by those skilled in the art that alternatively, shoulders 32 can be replaced by a collar, as long as upper compression spring 46 is caused to bear on or grip some portion of cartridge unit 28. This will also result in the desired rotation of the cartridge on release of the plunger, or depression of the plunger, depending on the mechanism for rotating gear 43.

SUMMARY OF THE ACHIEVEMENT OF THE OBJECT OF THE INVENTION

It will be recognized by those skilled in the art that the object of this invention has been achieved by providing an upper compression spring between the cartridge and plunger of a ball point pen whereby partial rotation of the cartridge is accomplished upon each occasion of release of the plunger, thus resulting in more even wear of the ball and nib and longer life of the cartridge.

While in accordance with the patent statutes a preferred (and alternative) embodiment of this invention has been illustrated and described in detail, it is to be particularly understood that the invention is not limited thereto or thereby.

I claim:

1. In an apparatus for projecting and retracting an elongated article in a housing having a project-retract mechanism including a non-rotatable stem for projecting said article, a rotatable intermediate member engaging said stem and said article, and spring biasing means bearing against said article and said housing for retracting said article, the improvement comprising a coil spring in compression disposed between and bearing against said article and said intermediate member, said spring having its longitudinal axis coincident with that of said article and said stem, whereby said coil spring causes said article to rotate incrementally through a portion of a circle each time said stem is depressed.

2. A ball point pen comprising:

an upper housing;

a lower housing removably engaging said upper housing to form a case having a longitudinal opening therethrough;

an ink-bearing cartridge centered in said case having a ball-carrying writing point at its lower end and an enlarged portion at its upper end, said cartridge being adapted to be projected and retracted through the opening in said lower housing;

spring biasing means in said lower housing adapted to urge said cartridge into a retracted position within said case;

a project-retract mechanism having a plunger adapted to protrude through the opening at the upper end of said upper housing and to move longitudinally in said upper housing;

a rotatable intermediate member adapted to engage the lower face of said plunger and the upper end of said cartridge, and to rotate incrementally through a portion of a circle upon actuation by said plunger;

a coil spring in compression disposed between and engaging said enlarged portion of said cartridge and said rotatable intermediate member, whereby rotation of said intermediate member causes rotation of said coil spring and concomitant rotation of said cartridge in said housing.

3. Apparatus according to claim 2 wherein said spring surrounds said cartridge and engages said cartridge by exerting compressive force on the outside of said cartridge.

4. Apparatus according to claim 2 wherein said cartridge includes a flattened shoulder near its upper end, and said spring engages said cartridge by partial insertion of said shoulder into said spring.

* * * * *